US005551601A

United States Patent [19]

Camm et al.

[11] Patent Number: 5,551,601

[45] Date of Patent: Sep. 3, 1996

[54] DISPENSER WITH INTERNAL DIAPHRAGM

[76] Inventors: James O. Camm, 51 Millewa Avenue, Chadstone, Victoria, 3184; Stephen J. Camm, 11 Kaisma Square, Wantirna, Victoria, 3152, both of Australia

[21] Appl. No.: 244,345

[22] PCT Filed: Nov. 11, 1992

[86] PCT No.: PCT/AU92/00604

§ 371 Date: May 25, 1994

§ 102(e) Date: May 25, 1994

[87] PCT Pub. No.: WO93/11059

PCT Pub. Date: Jun. 10, 1993

[30] Foreign Application Priority Data

Nov. 27, 1991 [AU] Australia ..... PK9708

[51] Int. Cl.[6] ..... B65D 35/22

[52] U.S. Cl. ..... 222/94; 222/95; 222/105; 222/137; 222/185.1; 222/389; 277/178

[58] Field of Search ..... 222/94, 95, 105, 222/135, 136, 137, 185, 386, 386.5, 389, 399, 481.5; 277/178, 200, 212 FB; 92/34, 44

[56] References Cited

U.S. PATENT DOCUMENTS

| | | | |
|---|---|---|---|
| 1,661,521 | 3/1928 | Zimmerman . | |
| 1,924,829 | 8/1933 | Bacher . | |
| 2,097,612 | 11/1937 | Arnold . | |
| 2,105,160 | 1/1938 | Piqueres | 221/74 |
| 2,649,995 | 8/1953 | Muskin | 222/105 |
| 2,708,600 | 5/1955 | Froidevaux . | |
| 2,728,494 | 12/1955 | Hobson | 222/386.5 |
| 2,738,227 | 3/1956 | Havens | 299/92 |
| 2,991,916 | 7/1961 | Kish | 222/386.5 |
| 3,186,597 | 6/1965 | Henderson | 222/30 |
| 3,847,308 | 11/1974 | Tambor | 222/95 |
| 4,085,865 | 4/1978 | Thompson et al. | 222/1 |
| 4,113,151 | 9/1978 | Brown et al. | 222/389 X |
| 4,154,377 | 5/1979 | Adams | 222/389 |
| 4,213,545 | 7/1980 | Thompson et al. | 222/386.5 |
| 4,419,096 | 12/1983 | Leeper et al. | 222/107 |
| 4,585,150 | 4/1986 | Beacham et al. | 222/481.5 X |
| 4,671,386 | 6/1987 | Orlitzky | 222/389 X |
| 4,690,306 | 9/1987 | Stahel | 222/389 X |
| 4,744,442 | 5/1988 | Bras et al. | 222/389 X |
| 4,801,046 | 1/1989 | Miczka | 222/389 X |
| 5,056,801 | 10/1991 | Beadle | 277/178 |
| 5,060,826 | 10/1991 | Coleman | 222/95 |
| 5,150,820 | 9/1992 | McGill | 222/95 |
| 5,305,929 | 4/1994 | Camm et al. | 222/386 |

FOREIGN PATENT DOCUMENTS

| | | | |
|---|---|---|---|
| 477027 | 1/1976 | Australia . | |
| A-5620690 | 6/1989 | Australia . | |
| 1056780 | 6/1979 | Canada | 222/95 |

*Primary Examiner*—Andres Kashnikow
*Assistant Examiner*—Joseph A. Kaufman
*Attorney, Agent, or Firm*—Larson and Taylor

[57] ABSTRACT

A dispenser is disclosed which includes a container having a base, a cylindrical side wall and a lid. A piston is arranged within the container between component and an air space between the piton and lid. A diaphragm is arranged within the air space and is sealed to the container between a rim of the container and a rim of the lid so that an enclosed volume is defined between the diaphragm and the lid. A rod extending between the base and lid and passing through the piston and diaphragm is provided to reinforce the container. The lid includes an air inlet for allowing compressed air to enter the enclosed volume to expand the diaphragm to thereby move the piston to dispense the component from the dispenser. In a further embodiment the diaphragm is replaced by an air bag located within the air space and bearing against the piston and lid.

31 Claims, 13 Drawing Sheets

DISPENSER WITH INTERNAL DIAPHRAGM

FIELD OF THE INVENTION

This invention relates to a dispenser for dispensing one or more components.

BACKGROUND OF THE INVENTION

Dispensers for dispensing one or more components are known and are made in a variety of different sizes. Conventional methods of expelling material from a twenty liter dispenser comprise pressurising the air space above the component in the dispenser. Usually a piston is inserted between the pressurised air and the component to be dispensed to prevent cavitation and loss of efficiency of expulsion. However, it is common for the pressurised air to still leak past the piston which is undesirable. Our copending Australian patent application 56206/90 discloses the use of an air bag to contain pressurised air, together with the use of a central rod to prevent bowing of the ends of the container. Whilst the invention disclosed in that application does provide adequate dispensing of components we have found that in some instances the bags burst unless prohibitably expensive materials are used. This bursting can be exacerbated because of the need of the air bag to wrap around the center rod which causes localized stresses.

The object of this invention is to overcome this problem.

SUMMARY OF THE INVENTION

The invention in a first aspect may be said to reside in a dispenser for dispensing a component, comprising:

a container for containing the component to be dispensed and a space in the container, the container having a first abutment portion;

a diaphragm arranged in said space and including an abutment section for abutment against said first abutment portion of the container;

a second abutment portion for engaging the abutment section of the diaphragm and for sandwiching the abutment section of the diaphragm between the first abutment portion of the container and the second abutment member;

a closing means for closing the container to define an enclosed volume with the diaphragm; and wherein the diaphragm is arranged in folded or collapsed fashion in the space in the container and wherein compressed fluid is supplied to the enclosed volume to cause the diaphragm to extend or expand to thereby dispense the component from the dispenser.

In the specification and in the claims the term "compressed fluid" should be taken to mean compressed gas as well as liquid under pressure.

Since the invention utilizes a diaphragm which is arranged in folded or collapsed fashion in the space and is retained between the first abutment portion of the container and a second abutment portion, the diaphragm easily expands to expel the component from the dispenser without bursting.

Preferably the first abutment portion of the container comprises an upper rim of the container and preferably the second abutment portion comprises a rim portion of a lid of the container, and preferably the abutment section of the diaphragm comprises a peripheral edge portion of the diaphragm which is sandwiched between the rim of the container and the rim of the lid when the lid is located on the container.

Preferably the closing means comprises the lid of the container and the diaphragm has a side wall and a base, the enclosed volume being defined between the diaphragm and the lid of the container.

Preferably a piston is disposed between the diaphragm and the component in the container.

Preferably the diaphragm has an attachment portion which is connected to the piston and the enclosed volume is defined between the lid of the container, the diaphragm and the piston.

In another embodiment of the invention the container includes a channel and a wall of the channel forms the first abutment portion of the container, the second abutment member being a ring which is received in the channel for sandwiching the abutment section of the diaphragm between the wall of the channel and the ring.

Preferably the container includes a reinforcing rod which extends between an upper portion of the container and a lower portion of the container, said diaphragm including an opening for receiving said rod and a seal member for sealing the diaphragm to the rod.

Preferably the seal member is movable longitudinally along the rod as the diaphragm moves to dispense material from the container.

Preferably the seal member comprises a strengthening ring, such as a washer, having a hole, which surrounds the opening in the diaphragm through which the rod passes, the diaphragm having a peripheral portion surrounding the opening and the peripheral portion extending into the hole of the washer between the washer and the rod, and said washer being coupled to said diaphragm.

Preferably the washer is coupled to the diaphragm by a patch, having an opening for accommodating the rod, overlapping the washer so that the washer is sandwiched between the diaphragm and the patch and diaphragm being heat welded together to secure the washer to the diaphragm.

Preferably the dispenser includes an air vent passage which communicates the space in the container with the exterior of the container, so that when the enclosed volume is filled with compressed air to expand the diaphragm, air in the space is expelled out of the space through the vent passage as the diaphragm expands to substantially fully occupy the space.

Preferably the vent passage comprises a bore through the rod, the bore having one end communicating with the exterior of the container and another end communicating with the space.

Preferably the dispenser is a dual dispenser for dispensing two components and includes a first container portion and a second container portion, the second container portion being arranged within the first container portion, and the diaphragm having an outer wall and an inner wall, the inner wall defining a cavity for accommodating the second container portion.

Preferably the diaphragm is folded in concertina fashion in the space prior to expansion.

Preferably both the outer wall and inner wall of the diaphragm are folded in concertina fashion and when compressed air fills the diaphragm to expand or extend the diaphragm the inner wall expands or extends over the second container portion.

A second aspect of the invention is concerned with venting an air space in the container. Venting of air from the container is of advantage particularly when the container is to be filled with a component which is air sensitive or in two component dispensers where accuracy is required. If air is forced under the piston it can displace some of the component thereby reducing accuracy for dual component dispensers.

This aspect of the invention may be said to reside in a dispenser for dispensing a component comprising:

a container for containing the component;

a space in the container;

an expandable fluid chamber arranged within the space for receiving compressed fluid for expanding the chamber to thereby dispense material from the container; and an air vent passage communicating the space with the exterior of the container, so that upon expansion of the fluid chamber air in the space is forced out of the space by expansion of the fluid chamber.

Preferably the container includes a rod which extends from an upper portion of the container to the bottom of the container.

Preferably the air vent passage comprises a bore extending through the rod and having one end communicating with the exterior of the container and another end communicating with the space in the container.

In another embodiment the vent passage could be a groove on the surface of the rod.

In another embodiment the air vent passage comprises a hose which is arranged within the air chamber and which has one end in communication with the space exterior of the air chamber and another end communicating with the exterior of the container.

Preferably the fluid chamber includes a diaphragm arranged in the space and which together with a lid of the container defines an enclosed volume for receipt of pressurised air to enable the diaphragm to expand.

Preferably the air vent passage has a closure plug for sealing the air vent passage after the diaphragm has expanded to expel substantially all of the air from the space to thereby prevent air from re-entering the space.

A further aspect of the invention is concerned with the manner in which the air is supplied to the dispenser to cause an air chamber within the dispenser to expand to dispense material from the dispenser.

This aspect of the invention may be said to reside in a dispenser for dispensing a component comprising:

a container for containing the component to be dispensed;

a space in the container;

an expandable fluid chamber arranged within the space for receiving compressed air; and a rod element extending through the container and into the expandable air chamber, the rod element having a passage therethrough which communicates with the expandable air chamber to enable compressed fluid to enter the expandable fluid chamber to expand the expandable fluid chamber.

Preferably the rod comprises a reinforcing rod which extends from a top portion of the container to a bottom portion of the container and the passage in the rod extends from an upper portion of the rod, through the rod and communicates with the interior of the expandable fluid chamber.

A further aspect of the invention relates to the manner in which the expandable member is arranged within the air space so as to enable easy expansion of the expandable member. We have found that when using an air bag or other expandable member in a container there is a tendency for the expandable member to be forced against the side walls of the container as the expandable member is filled with compressed air. This can cause unextended or unexpanded side wall portions of the expandable member to stick to the side walls of the container which inhibits full expansion of the expandable member and, in some circumstances can cause the expandable member to stop moving so that all of the component in the dispenser is not able to be dispensed.

This aspect of the invention concerns a dispenser which overcomes this problem.

This aspect of the invention may be said to reside in a dispenser for dispensing a component comprising:

a container for containing the component to be dispensed;

a space in the container;

a piston arranged between the component and the space, said piston having a base portion for contacting the component to be dispensed and an upstanding wall portion;

an expandable fluid chamber arranged within the space and at least a portion of the expandable air chamber being folded so that the folded portion of the air chamber is within the confines of the piston defined by the base and upstanding wall of the piston; and wherein when the expandable air chamber is filled with compressed fluid, the piston is forced downwardly and with the folded expandable fluid chamber being drawn out of the confines of the piston as the piston moves downwardly to prevent the folded portion of the fluid chamber from contacting the side wall of the container and adhering to the side wall of the container due to pressure within the fluid chamber.

Since the expandable fluid chamber is folded within the confines of the piston the pressurised fluid does not force the folded part or unexpanded or unextended portion of the expandable fluid chamber into contact with the container wall which may cause the expandable fluid chamber to adhere to the wall and prevent full expansion of the expandable member. Rather, the unexpanded portion of the expandable fluid chamber moves downwardly with the piston and is effectively dragged out of the piston as the piston and expandable air chamber move within the container so that only those portions of the expandable air chamber drawn out of the piston can contact the side wall of the container.

Preferably the expandable fluid chamber comprises a diaphragm which has an upper portion fixed to the container. In other embodiments it could be a bag or the like.

A further aspect of the invention may be said to reside in an air bag for a dispenser which includes a container for housing a component to be dispensed, comprising:

a bag body defining a volume for receipt of compressed fluid to enable the bag to expand;

a first hole in the bag body and a second hole in the bag body for receiving a rod so that the rod can pass through the first hole, through the volume and through the second hole; and seal means for sealing at least one of the holes to the rod and the other hole to the rod or to the container when the rod is located in the holes.

Preferably the sealing means comprises a respective seal for each hole, each seal having a washer which has a hole, which surrounds a respective one of the holes in the bag, the bag having a peripheral portion surrounding each hole and the peripheral portion extending into the hole of the respective washer between the washer and the rod when the rod is located through the holes, and said washer being coupled to the bag.

A further aspect of the invention concerns the manner in which the diaphragm is arranged within the container for expansion.

This aspect of the invention may be said to reside in a dispenser for dispensing a component comprising:

a container for containing the component;

a space within the container;

a piston arranged within the dispenser between the space and the component;

a diaphragm having a first end and a second end, the first end being fixed to the container and the second end being fixed to the piston;

a lid for closing the container; and wherein, the lid, the diaphragm and the piston define an enclosed volume for receiving compressed fluid to expand the diaphragm and therefore cause the piston to move and dispense the component from the diaphragm.

A final aspect of the invention concerns the manner in which the component is expelled from the dispenser. Conventional dispensers utilize either a piston which seals to the internal wall of the container with a view to preventing the component from moving past the piston as the piston moves in the container. The need to cause the piston to seal in the container requires the container to be machined so as to remove irregularities and also for the use of O-rings and the like in the piston. This increases manufacturing costs and also makes assembly more difficult.

Another known arrangement is to use a plate which is significantly smaller than the internal diameter of the container and for a thick diaphragm to be attached to the plate and for the diaphragm to extend below the plate into the area in which the component is stored. The diaphragm must be thick in order to withstand the stresses and forces which are applied to it during movement of the plate. In order to expel the component the plate is forced downwardly and the portion of the diaphragm which is arranged below the plate accommodates downward movement of the plate This arrangement also is expensive in view of the need to provide a thick diaphragm. Also, it is unsuitable for two component dispensers because variations in the volume taken up by the diaphragm causes inaccuracy in dispensing.

An object of this aspect of the invention is to provide a single and cost effective arrangement for expelling the component from the dispenser.

This aspect of the invention may be said to reside in a dispenser for dispensing a component comprising:

a container, having a side wall, for containing the component;

a space within the container;

a piston arranged within the dispenser between the space and the component, the piston being in contact with the side wall but not forming a seal with the side wall;

a diaphragm connected to the container and being arranged in the space;

a lid for closing the container so that the lid and diaphragm form an enclosed volume within the container for receiving compressed fluid to expand the diaphragm and cause the piston to move and dispense the component from the diaphragm; and wherein the piston is of such a size and the diaphragm is of such a resiliency that said diaphragm is substantially prevented from lodging between the piston and the side wall of the container and therefore into the area in which the component is retained.

BRIEF DESCRIPTION OF THE DRAWINGS

Preferred embodiments of the invention will be described, by way of example, with reference to the accompanying drawings in which.

DETAILED DESCRIPTION OF THE PREFERRED EMBODIMENTS

Figure 1:
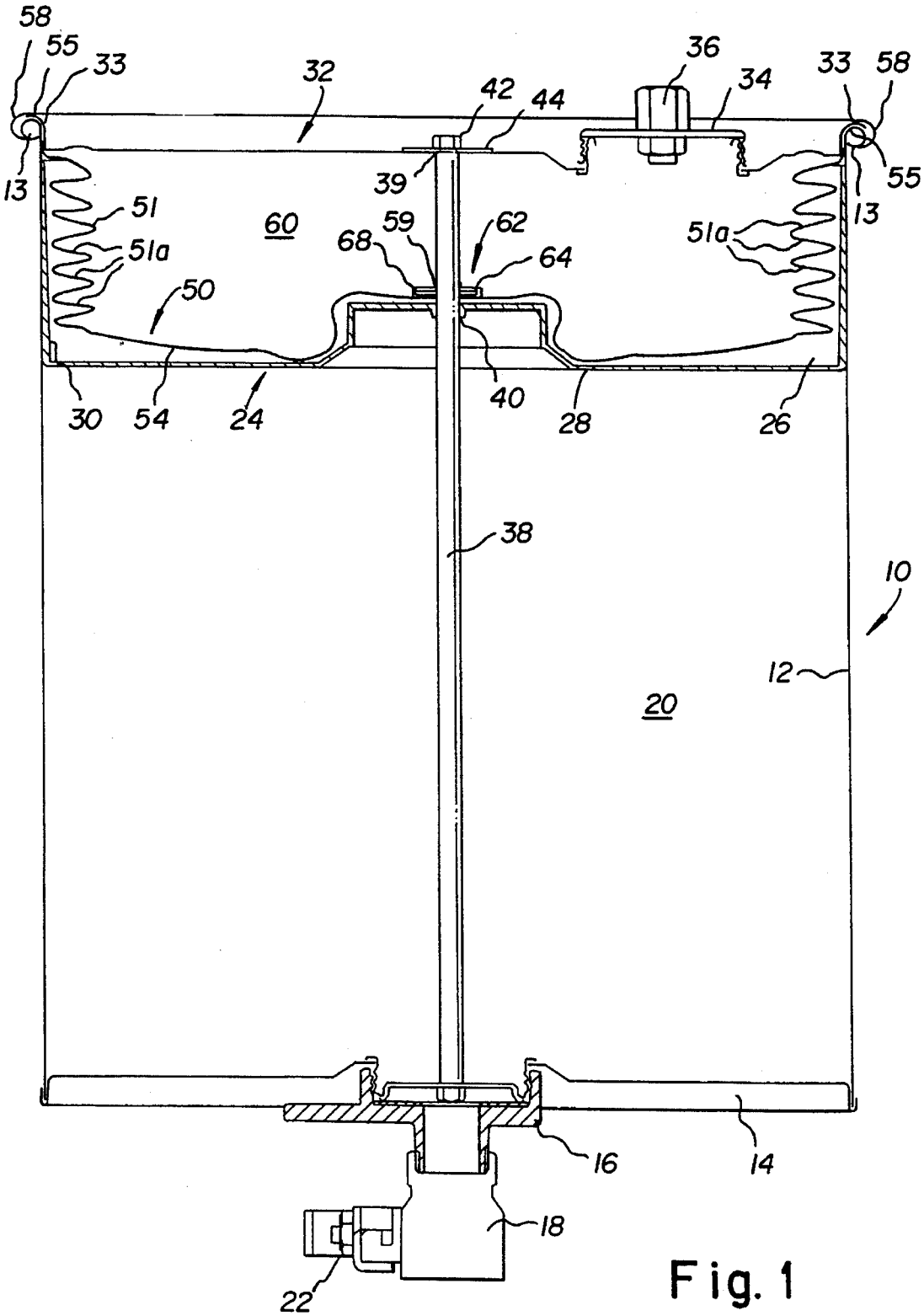
FIG. 1 is a view of a dispenser according to the first embodiment of the invention.

With reference to FIG. 1, a dispenser is shown which comprises a container 10 which has a cylindrical side wall 12 and a base 14. The base 14 is provided with an outlet 16 to which a valve 18 is coupled for enabling a component 20 within the container 10 to be dispensed. The valve 18 has a handle 22 which can be adjusted to open and close the valve to allow the material to exit the container.

A piston 24 is arranged within the container and is located between the component 20 within the container and a space 26. The piston 24 has a base 28 which contacts the component 20 and a side wall 30 which is a close fit to the side wall 12 of the container 10. A lid 32 is provided for closing the container 10 and the lid 32 has a cap 34 which is screw threaded to the lid 32 and includes an air inlet 36.

A reinforcing rod 38 extends between the base 14 of the container and the lid 32 of the container. The reinforcing rod 32 passes through a hole 40 in the piston 24. The rod 38 passes through a hole 39 in the lid 32 when the lid 32 is located on the container and a washer 44 and nut 42 secure the rod 38 to the lid 32.

Figure 2:
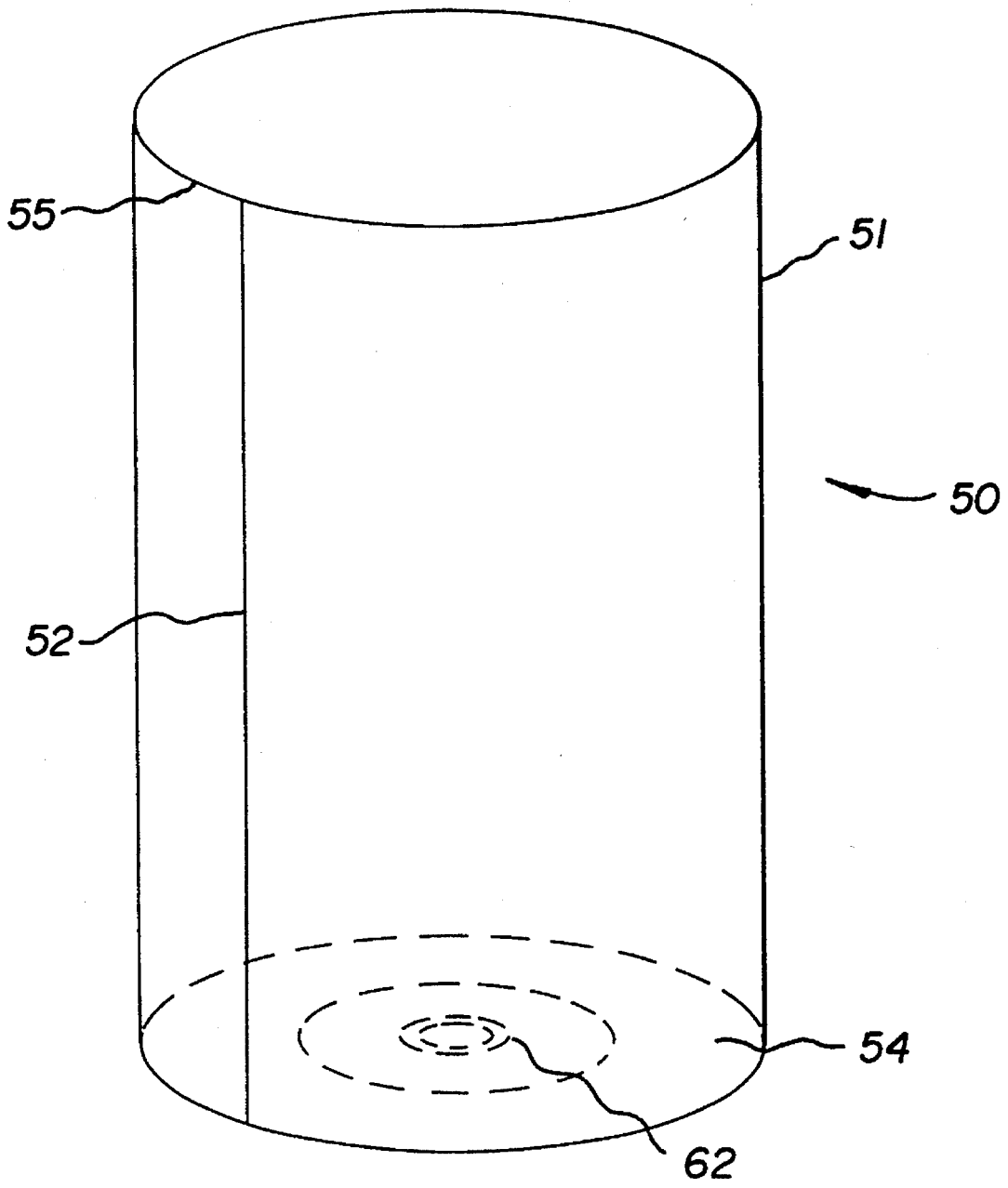
FIG. 2 is a view of a diaphragm used in the embodiment of FIG. 1.

A diaphragm 50 is arranged within the air space 26. The diaphragm 50 is shown in FIG. 2 and is generally cylindrical in nature having a cylindrical side wall 51 which is formed from a rectangular plastics sheet joined at a seam 52, and a base 54 which is also joined to the bottom of the cylindrical wall 51. The joints may be formed by heat welding or any other suitable method. The diaphragm 50 has an open top. Alternatively the diaphragm could be blow moulded in one piece.

Figure 1A:
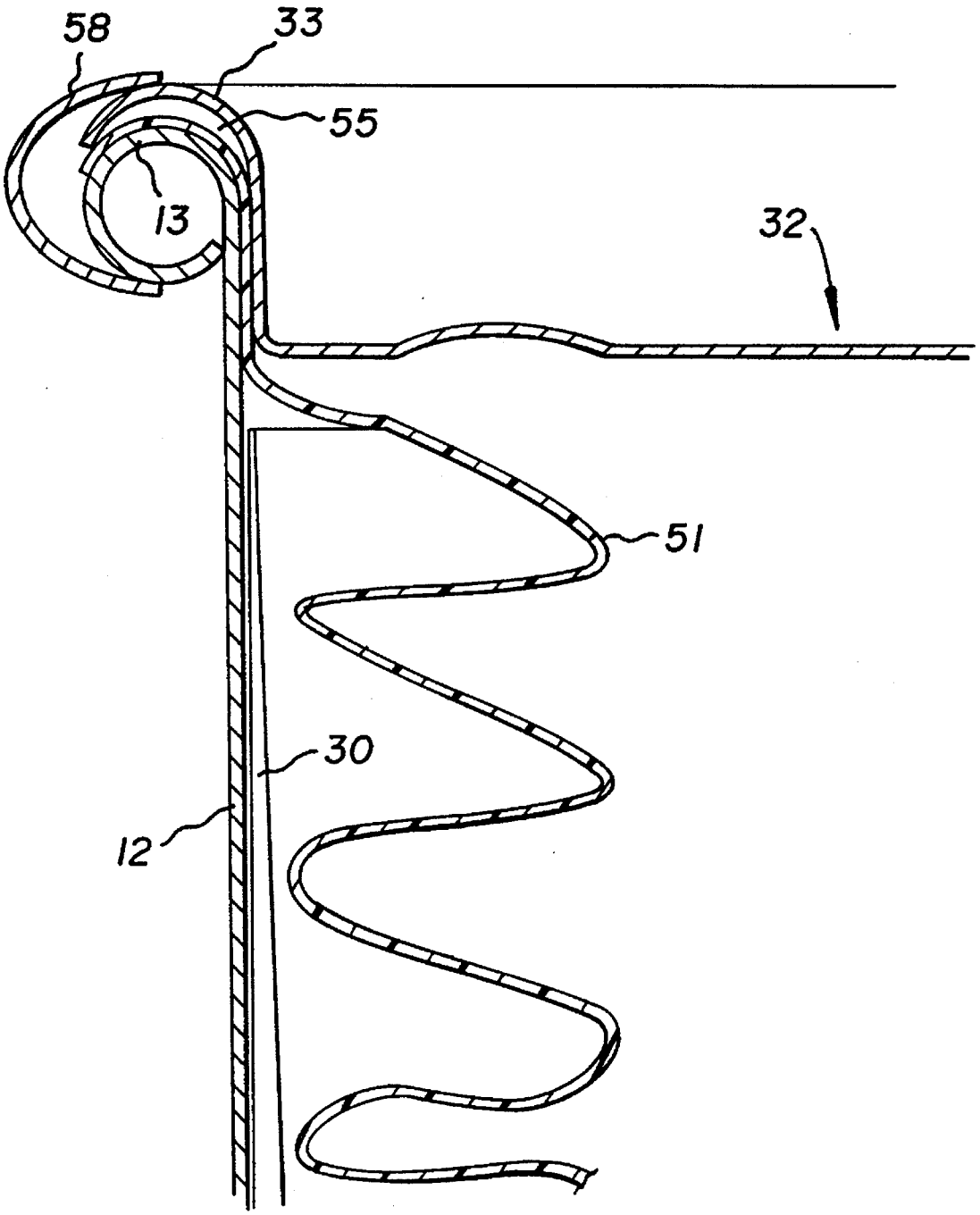
FIG. 1A is a detailed view of part of FIG. 1.

As is best shown in FIG. 1A, the container 12 has an upper rim 13 and the lid 32 has a rim 33 which seats onto the rim 13. An upper peripheral edge 55 of the diaphragm 50 is arranged between the rim 13 and the rim 33 and is sandwiched between the rim 13 and rim 33 when the lid 32 is in place on the container as shown in FIG. 1. An annular locating clip 58 which is of C shape in cross section locks the lid 32 to the container 12 by engaging the underside of the rim 13 and the upper side of the rim 33 to thereby securely bias the lid 32 onto the container 12. Alternatively deformable lugs could be located on the lid and folded over to engage the container, to thereby fix the lid to the container. The diaphragm 50 is therefore sandwiched between the lid 32 and the container 12 and together with the lid 32 defines an enclosed volume 60 for receiving compressed air via the inlet 36 to expand the diaphragm 50 to thereby push the piston 24 and expel the component 20 through the valve 18.

The reinforcing rod 38 extends through the diaphragm 50 and a sealing member 62 is provided for sealing against the rod 38 to allow movement longitudinally of the rod 38 as the diaphragm 50 expands. As best shown in fixtures 2 and 3 the sealing member 62 comprises a washer 64 which is preferably formed of fibrous material, such as a conventional tap washer, which has a hole 66 which is in register with a hole 57 in the diaphragm 50. A patch 68 is located over the washer 64 so that the washer 64 is sandwiched between the patch 68 and the diaphragm 50. The patch 68 is heat welded circumferentially at 67' adjacent inner and outer edges of the washer to the base 54 of diaphragm 50 and has a hole 61 for accommodating the rod 38. The washer 64 provides strength and rigidity in the vicinity of hole 57 to prevent the diaphragm 50 from pulling away from rod 38 and breaking the seal.

The peripheral portion 59 of base 54, which surrounds hole 57, is arranged in the hole 66 of the washer 64 and is pushed upwardly and sandwiched between the internal wall 67 of the washer 64 and the rod 38 (as seen in FIG. 1) when the rod 38 is inserted through the hole 57 in the base 54 of the diaphragm 50. The hole 66 in the washer 64 is a reasonably tight fit with the rod 38 so that sandwiching of the peripheral portion 59 of the base 54 of the diaphragm 50 forms a good lip seal with the rod 38 yet allows the sealing member 62 to move longitudinally along the rod as the diaphragm expands.

As is best shown in FIG. 1 the diaphragm 50 is folded in concertina fashion so that it is relatively flat and is located within the confines of the piston 24 defined by wall 30 and base 28 of the piston 24. The folded portion of the diaphragm (which is basically the cylindrical wall 51) has sections **51*a* which are arranged transverse to the direction of movement of the piston 24. The diaphragm, apart from the peripheral portion 55 which is sandwiched between rims 13 and 33 therefore does not have any substantial contact with the wall 12 of the container 10 but is retained within the confines of the piston 24. As the piston 24 moves downwardly when compressed air is forced through inlet 36 into the volume 60, the wall 51 of the diaphragm is effectively pulled out of the confines of the wall 30 of the piston 24 to contact with the side wall 12 of the container. Thus, the concertina folded portion of the side wall 51 does not contact the side wall 12 of the container until the diaphragm expands. That is, the side wall 51 only contacts the side wall 12 of the container as the diaphragm 50 is drawn out of the confines of the piston 30 as the piston 30 is moved downwardly. This prevents the folded portion of the side wall 51 of the diaphragm from being forced against the side wall of the container 12 prematurely and sticking or adhering to the side wall 12 due to pressure within the space 60 which may otherwise prevent full expansion of the diaphragm 54 and therefore dispensing of all of the component 20 within the container 10**.

As the piston 24 moves in the container and the diaphragm is dragged out of the container, the diaphragm 50 is forced against the wall 12 of the container due to the pressure of the air in the diaphragm 50. The side wall 51 of the diaphragm therefore effectively adheres against the side wall 12 of the container 10 just above the top of the side wall 30 of the piston 24. The adherence of the side wall 51 of the diaphragm 50 effectively forms a seal for reducing the amount of component which is able to pass between the internal surface of the wall 12 and the wall 30 of the piston into the space 26 above the piston 24.

In practice it has been found that only a small amount of component which fills irregularities in the side wall 12 of the container is able to move past the piston 24 as the piston moves downwardly in the container 10.

The diaphragm 50 is retained above the piston and does not extend below it, notwithstanding the fact that the piston 24 does not seal against the side wall 12 of the container 10. In this regard, the diaphragm has a resiliency and the piston 24 is dimensioned so that the diaphragm 50 does not fall and lodge between the piston 24 and the side wall 12. Because the diaphragm is supported by the wall 12 and the piston 24 it can be of relatively light gauge material and even of a material which is softened by the contents of the container 10. Also 20 liter cans with imperfections on the walls can be used without modification and the tolerances on the piston 24 are not critical compared with sealing pistons.

Figure 3:
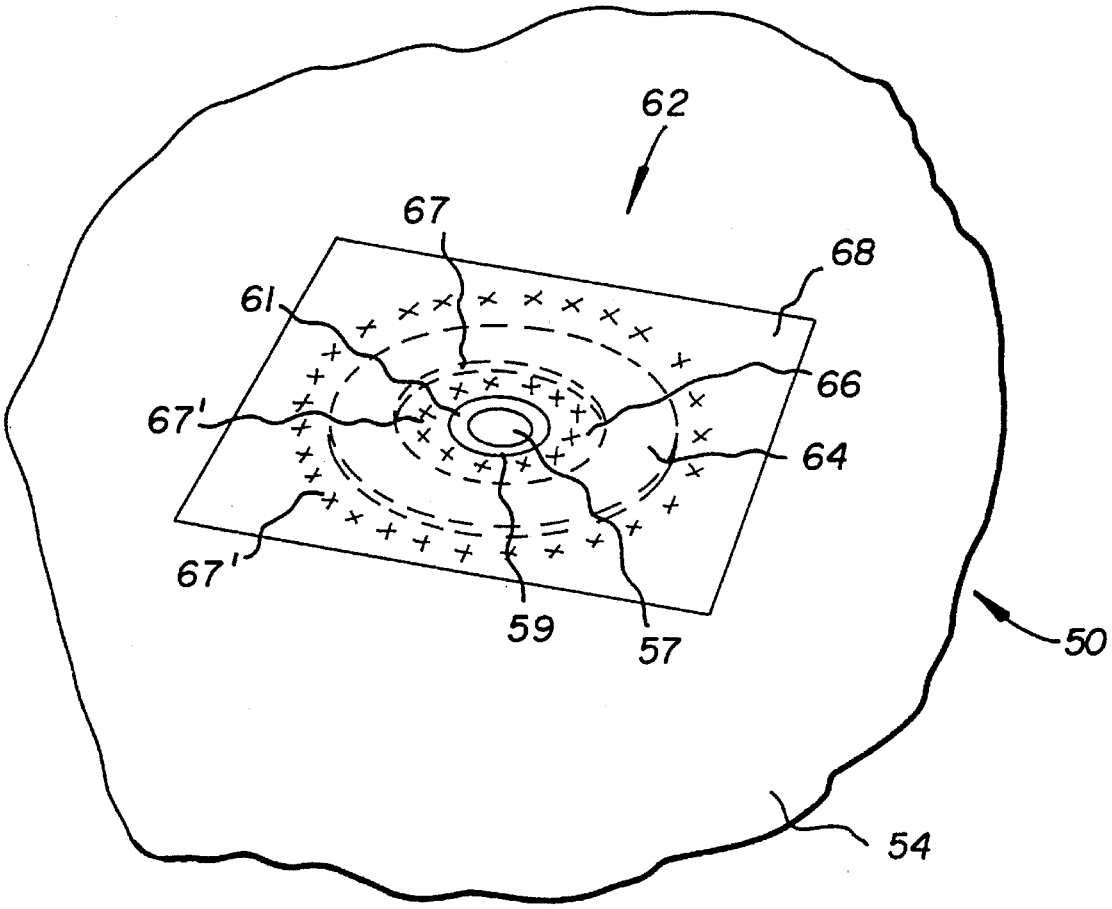
FIG. 3 is a detailed view of part of the diaphragm of FIG. 2.
Figure 4:
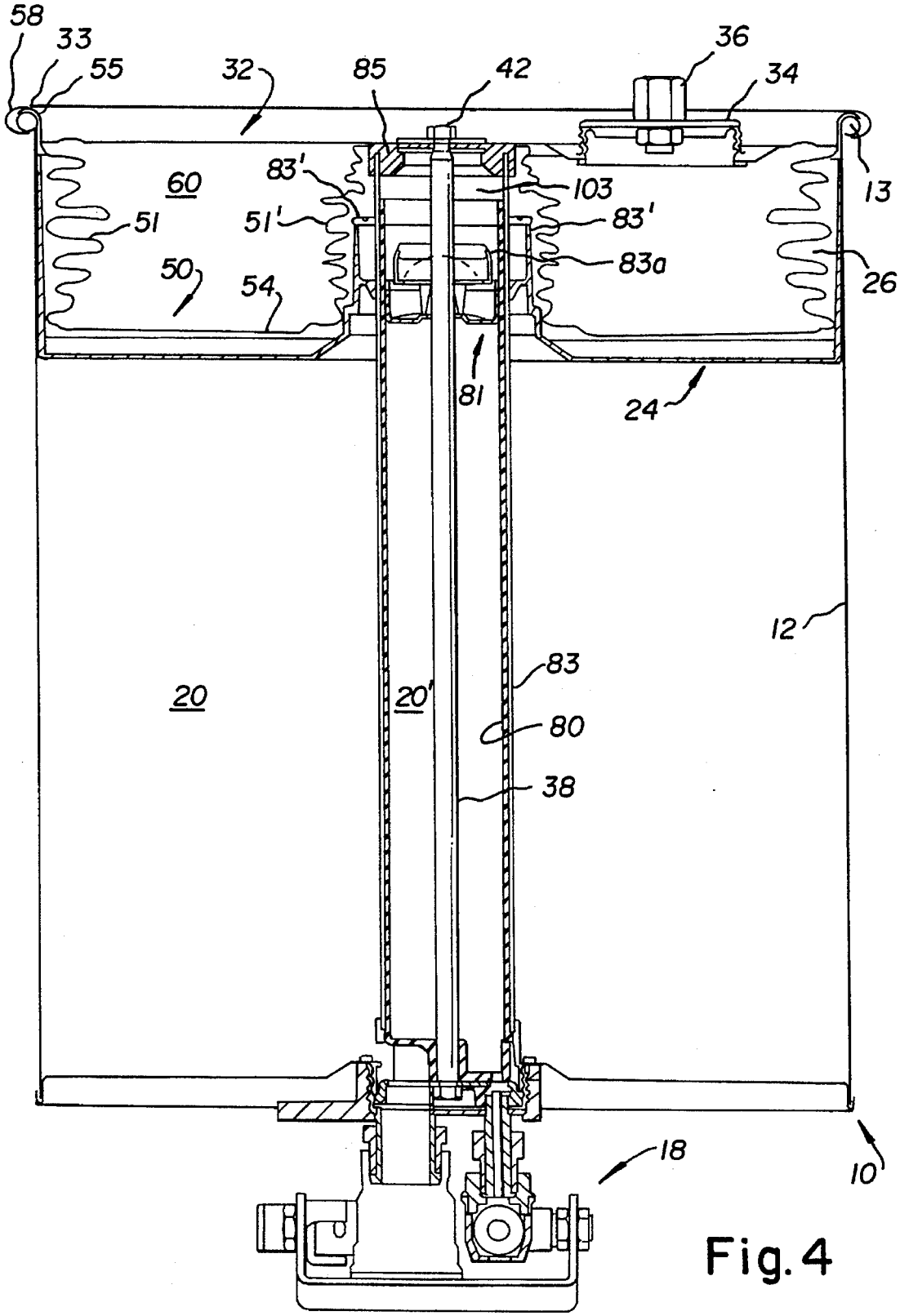
FIG. 4 is a view of a second embodiment of the invention.

FIG. 4 shows a second embodiment of the invention in which like reference numerals indicate like parts to those described with reference to FIGS. 1 to 3. In this embodiment the dispenser is intended for dispensing two components 20 and 20'. The component 20' is retained within a cylindrical cartridge 80 which includes a second piston 81 and a blade assembly **83*a* for slicing the cartridge 80 and a tubular container 83 within which the cartridge 80 is located. In this embodiment the valve 18 is a dual valve for dispensing the components 20 and 20' separately from the dispenser. Full details of the valve 18, the blade assembly 83*a* together with the cartridge 80 and tube 83** can be obtained in our copending International patent applications PCT/AU90/00575 and PCT/AU92/00287 the contents of which are incorporated herein by this reference.

Figure 5:
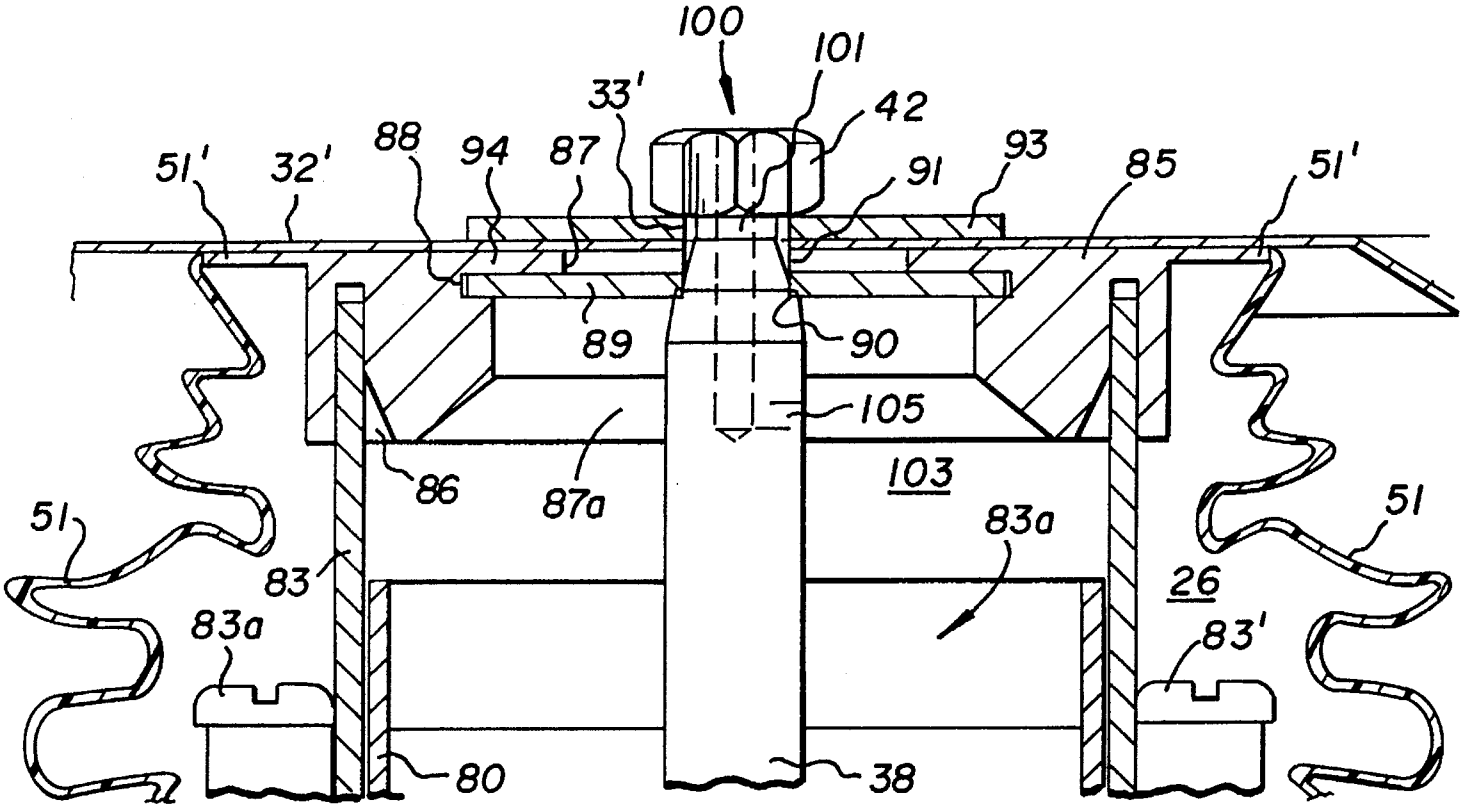
FIG. 5 is a detailed view of part of the embodiment of FIG. 4.

In this embodiment of the invention the diaphragm 50 has an external cylindrical wall 51 and an internal cylindrical wall 51' which are joined by base section 54 to define an annular shaped volume 60. The periphery 55 of the external wall 51 is sandwiched between rims 13 and 33 as in the embodiment of FIG. 1. The cylindrical wall 51', as is best shown in FIG. 5, is welded to a plug 85. The plug 85 has a circular channel 86 which receives the upper end of tube 83 in which cartridge 80 is located. The plug 85 has a central opening **87*a* which includes a groove 88. A steel washer 89, is pushed through opening 87*a* and forced into groove 88 by virtue of the resiliency of the plastic material from which the plug 85 is made. The rod 38 has an upper shoulder 90 and a reduced diameter portion 91 which passes through the washer 89 and a reduced diameter portion 87 of the opening 87*a* so that the shoulder 90 engages the washer 89**.

The lid 32 may be located on the container 10 by passing the reduced diameter portion 91 of the rod 38 through a hole 33' in the middle of flat planar section 32' of the lid 32. A second washer 93 is then located on the reduced diameter portion 91 and sits on flat planar portion 32' of the lid 32. Nut 42 may then be screwed onto the reduced diameter portion 91 of the rod 38. The flange 94 of the plug 85 is therefore arranged between the washer 89 and the planar section 32' of the lid beneath the washer 93. When nut 42 is screwed tightly onto rod 38 the washers 89 and 93 are pressed tightly together to thereby tightly sandwich the flange 94 and planar section 32' of the lid 32 between the washers 89 and 93 to thereby seal the top of the diaphragm portion 51' and to define annular enclosed volume 60 within the diaphragm 50 and lid 32.

Alternatively a portion of the diaphragm could be sandwiched between the flange 94 and portion 32' of lid 32. In this arrangement the rod 38 would merely pierce the diagram when it passes through opening 87*a*.

When compressed air is forced into the enclosed volume 60 the piston 24 is forced downwardly in FIG. 4. The blade arrangement 83*a* which is coupled to the piston 24 by screws 83' moves downwardly with the piston so the blade assembly slices the tube 83 and cartridge 80 and pushes the second piston 81 in the manner described in the above mentioned PCT applications so that the components 20 and 20' are simultaneously dispensed from the dispenser through the valve 18.

Once again the diaphragm 50 is arranged within the confines of the piston 24 and is drawn out of the confines of the piston 24 as the piston 24 moves downwardly.

As is best shown in FIG. 5 this embodiment includes a vent passage 100 for venting air out the space 26 when the enclosed volume 60 receives compressed air and the diaphragm 50 expands outwardly to occupy the space 26. All the trapped air trapped within the air space 26 is then forced out of the container so that it will not hamper free expansion of the diaphragm 50 and movement of piston 24 to prevent air being forced past the piston which can disrupt the accuracy of the metering of two components in a two component dispenser. The vent passage 100, in the embodiment of FIG. 5, is provided in rod 38 and comprises a longitudinal bore 101 which extends downwardly from the top of rod 38 a short distance into cavity 103 defined within tube 83. A transverse bore 105 extends from the bore 101 and communicates with the cavity 103. The cavity 103 is in communication with the space 26 so that as the diaphragm 50 expands to occupy the full volume of the space 26, before or just as the piston 24 is pushed by expansion of the diaphragm 50, trapped air in the space 26 is forced out of the space 26 to allow the diaphragm 50 to freely expand and occupy substantially all the space 26 without interference or hindrance of any trapped air within the space 26.

Figure 6:
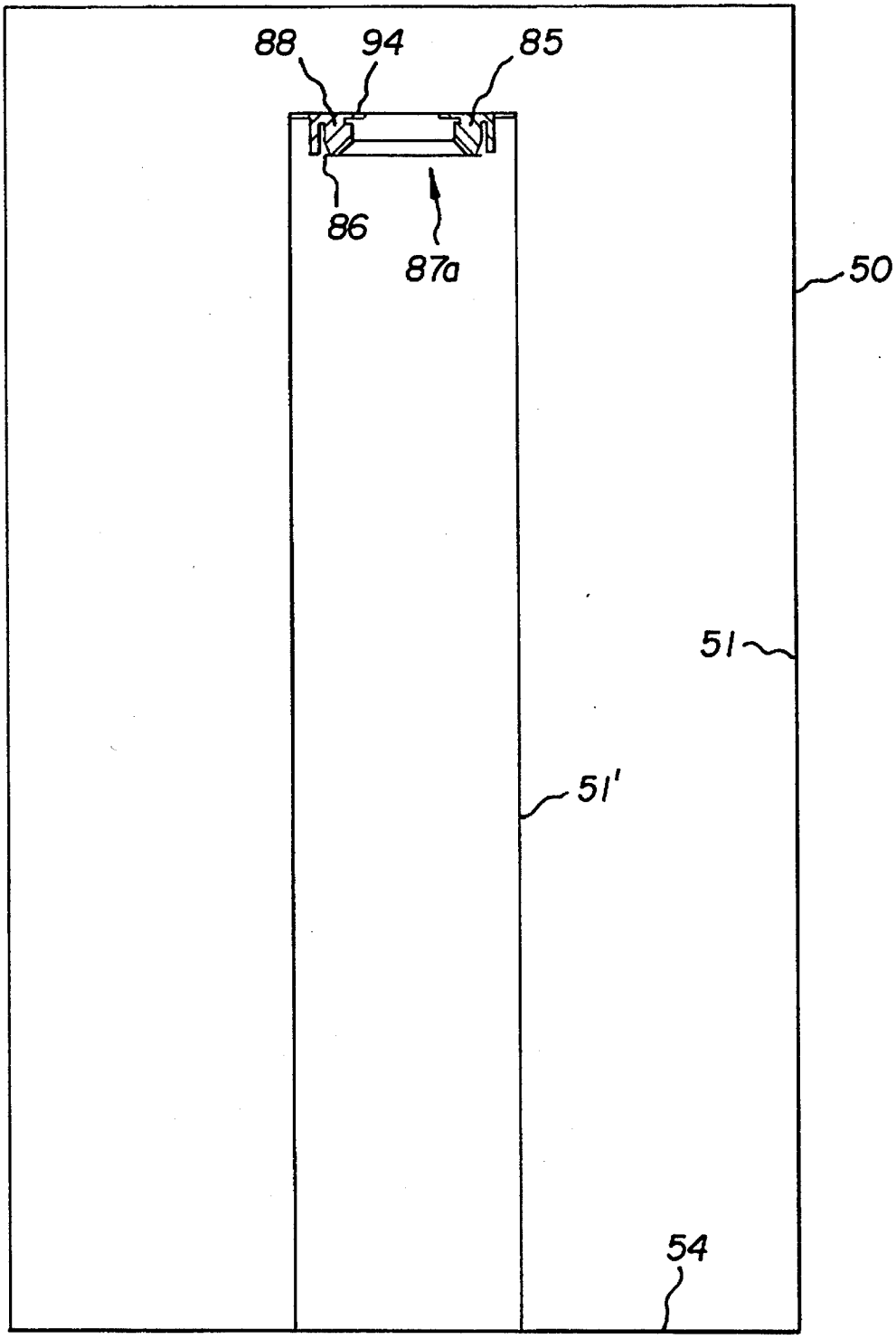
FIG. 6 is a view of a diaphragm used in the embodiment of FIG. 4.
Figure 7:
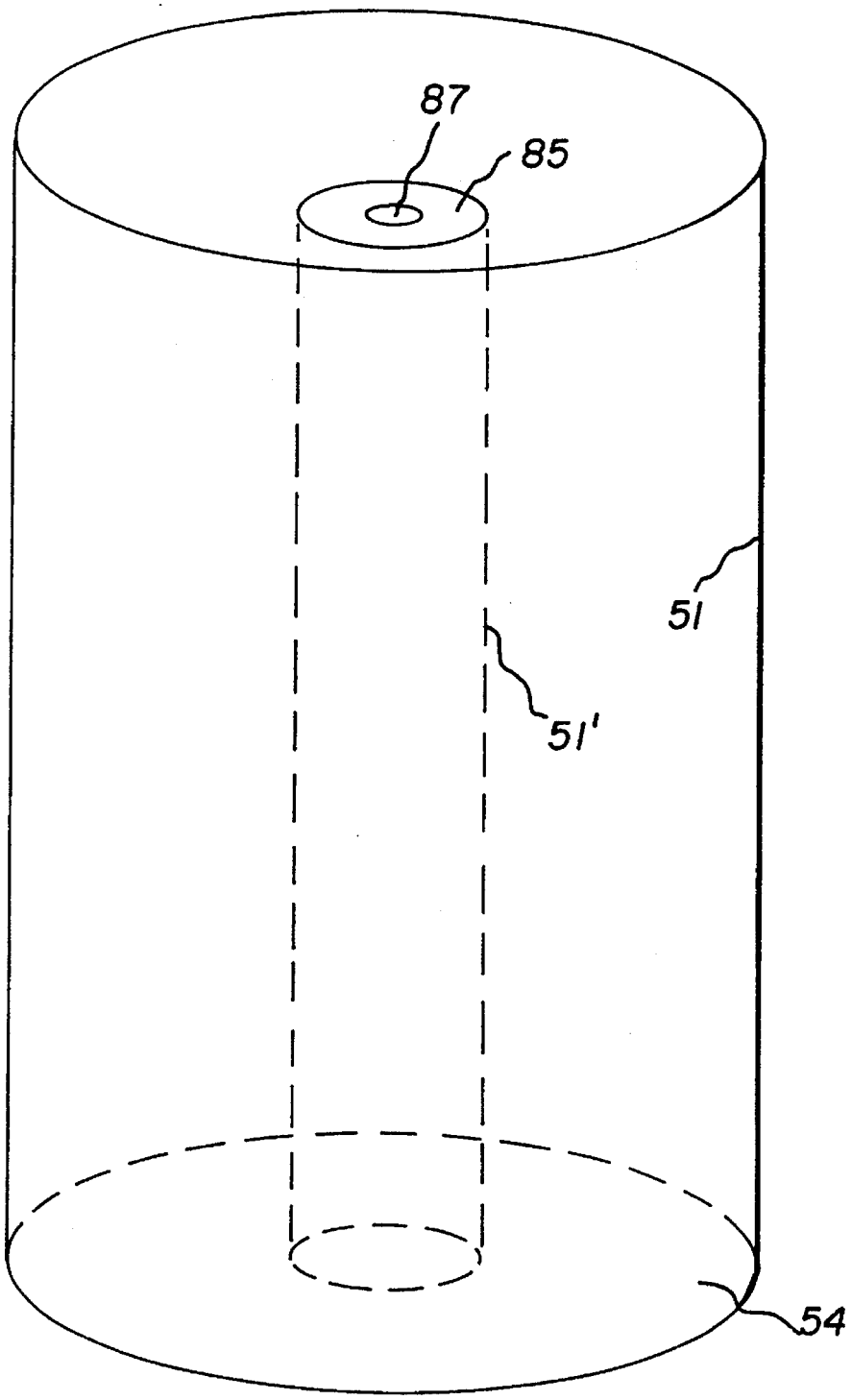
FIG. 7 is a perspective view of a diaphragm of FIG. 6.

The diaphragm used in FIGS. 4 and 5 is shown in FIGS. 6 and 7 which show the internal and external walls 51 and 51' and base 54. The plug 85 is formed with the diaphragm 50.

Figure 8:
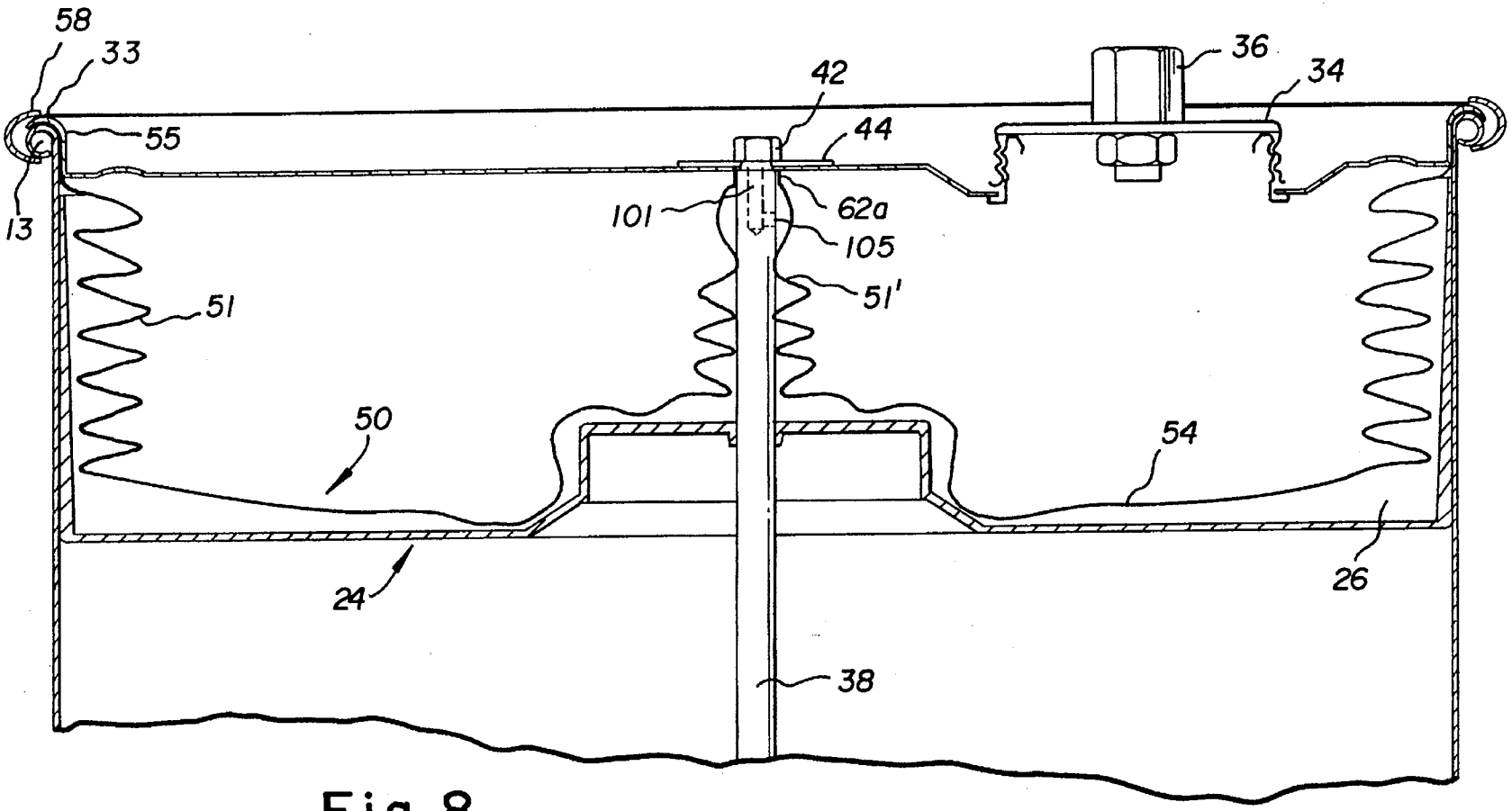
FIG. 8 is a detailed view of a third embodiment of the invention.

FIG. 8 shows an embodiment which is similar to FIG. 4 except that the dispenser is a single component dispenser and the diaphragm is similar to the diaphragm shown in FIG. 4 with the internal cylindrical wall portion 51' being sealed by a sealing member 62*a* to rod 38.

In the embodiment of FIG. 8, adherence of the unexpanded portion of diaphragm wall 51' to rod 38 is easily overcome because of the small surface area involved.

This embodiment also includes the bores 101, 105 for allowing air to escape from space 26 when the diaphragm expands or extends to fill the space 26.

Figure 9:
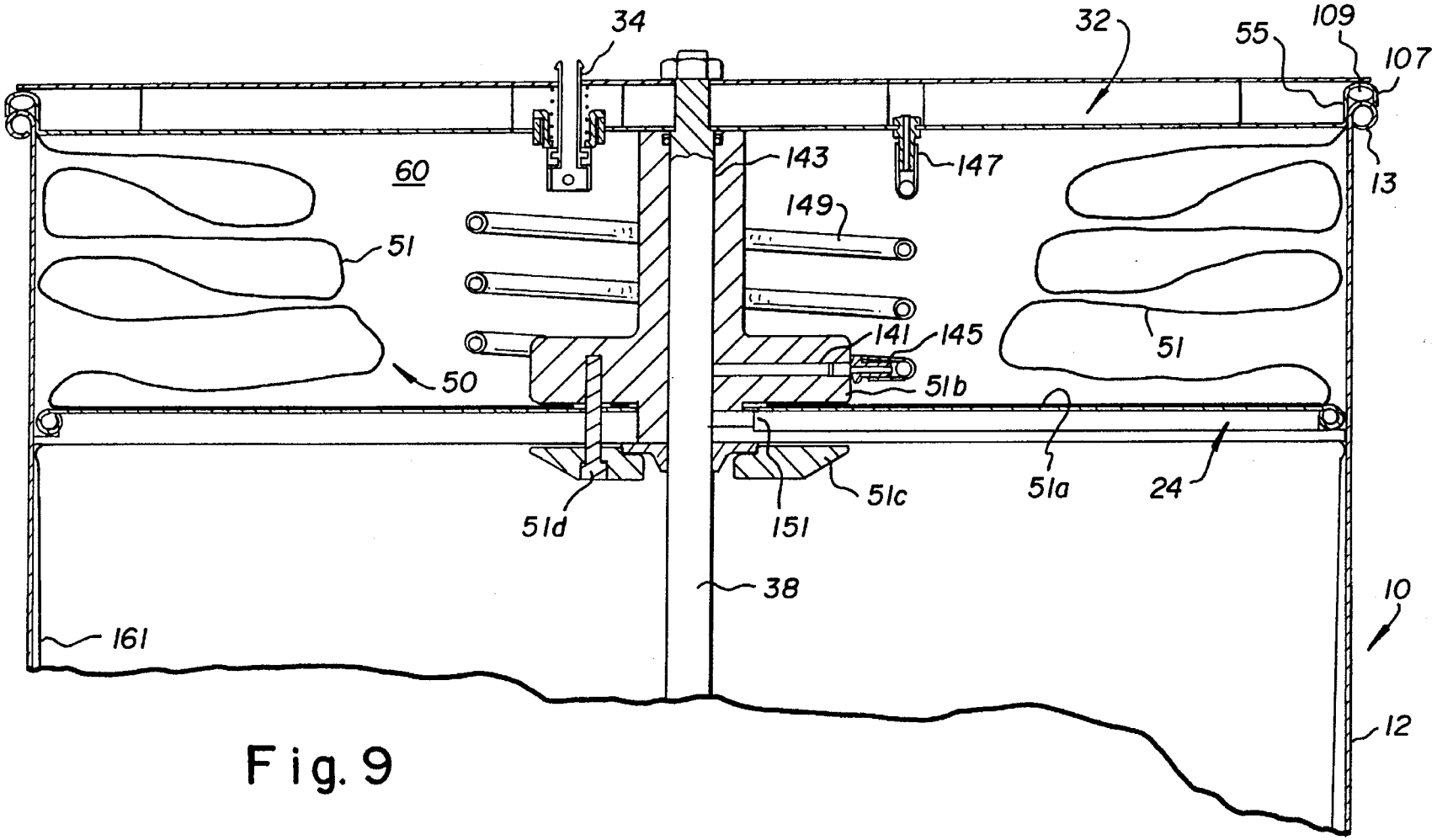
FIG. 9 is a detailed view of a fourth embodiment of the invention.

FIG. 9 shows a further embodiment of the invention which includes a container 10 having a cylindrical wall 12 which has a rim 13. A lid 32 is located on the rim 13 and has a rim 107. A ring member 109 is located within the rim 107 and sandwiches a peripheral portion 55 of diaphragm 50. The diaphragm 50 comprises a cylindrical wall 51. The bottom of cylindrical wall 51 is adhered or otherwise attached to piston 24. Preferably the diaphragm 50 has a base 54 which extends along the top of the piston 24 and is clamped between central support 51*b* and the piston 24. A clamp 51*c* is fixed to the central support 51*b* by bolts 51*d*. The lid 32 includes an inlet 34 for air. When compressed air passes through inlet 34 to space 60 defined between the lid 32, the piston 24 and the cylindrical diaphragm 50, the piston 24 is forced downwardly drawing the diaphragm 50 with it as it moves.

The central support 51*b* is provided with a bore 141 which extends from a central bore 143 through which rod 38 passes to the periphery of the central support 51*b*. A coupling 145 is connected to the bore 141 and a similar coupling 147 is arranged in the lid 32. A spiral hose 149 extends between the couplings 147 and 145.

When the diaphragm 50 expands air is forced from the space 26 between the bottom 51*a* of the diaphragm and the piston 24 and through a passage 151 which communicates with the bore 143 and the central support 51*b*. There is sufficient space between the rod 38 and the central support 51*b* for the air to pass through the bore 143, into the bore 141, and then into hose 149 to exit the container through coupling 147. If necessary the piston 24 can be provided with grooving (not shown) or the like so that air can easily pass between the piston 24 and the bottom of diaphragm 51*a* particularly in the vicinity where the diaphragm 51*a* is clamped between the piston 24 and the central support 51*b*. The grooving communicates with the passage 151 to enable the air to escape from the space 26.

In this embodiment of the invention the piston 24 need not be provided with a side wall and the central support 51*b*, which is fixed to the piston 24 by the clamp 51*c*, moves downwardly with the piston 24 and provides rigidity to ensure the piston moves downwardly in a horizontal orientation as shown in FIG. 9 and does not tend to tilt which may cause jamming or the like.

This embodiment of the invention may also include a bag 161 for containing the component to be dispensed from the dispenser 10.

Figure 10:
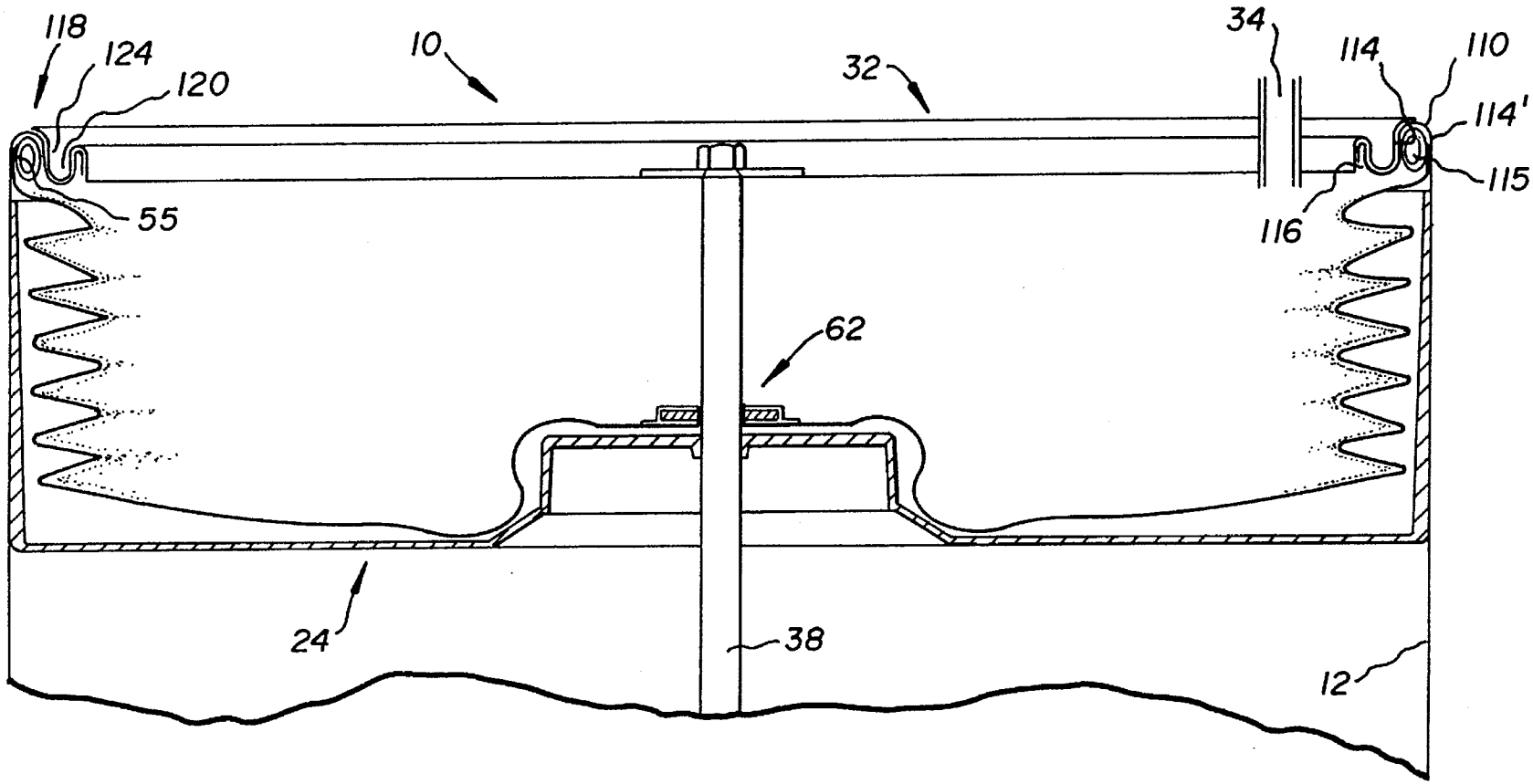
FIG. 10 is a detailed view of a fifth embodiment of the invention.

FIG. 10 shows a still further embodiment in which the container 10 is of smaller volume and wherein the lid 32 is sealed to the cylindrical wall 12 of the container 10 in much the same manner as a paint can is sealed. Cylindrical wall 12 has a rim 110 which includes a first channel 114 which opens downwardly and a second channel 116 which opens upwardly. The lid 32 has a flange portion 118 which is arranged between a downwardly opening channel 120 and a rim 124. In this embodiment the upper peripheral portion 55 of the diaphragm 50 is arranged in the channel 114 and is sandwiched between an external wall 114' of the channel 114 and a ring 115 of plastics material or the like which is inserted into the channel 114 and which is a tight fit in the channel.

This embodiment may include a rod 38 and a sealing member 62 similar to that previously described. An air inlet 34 is provided for inserting air into the enclosed volume 60 to expand the diaphragm and push the piston 24 downwardly to dispense component 20 from the dispenser 10.

Figure 11:
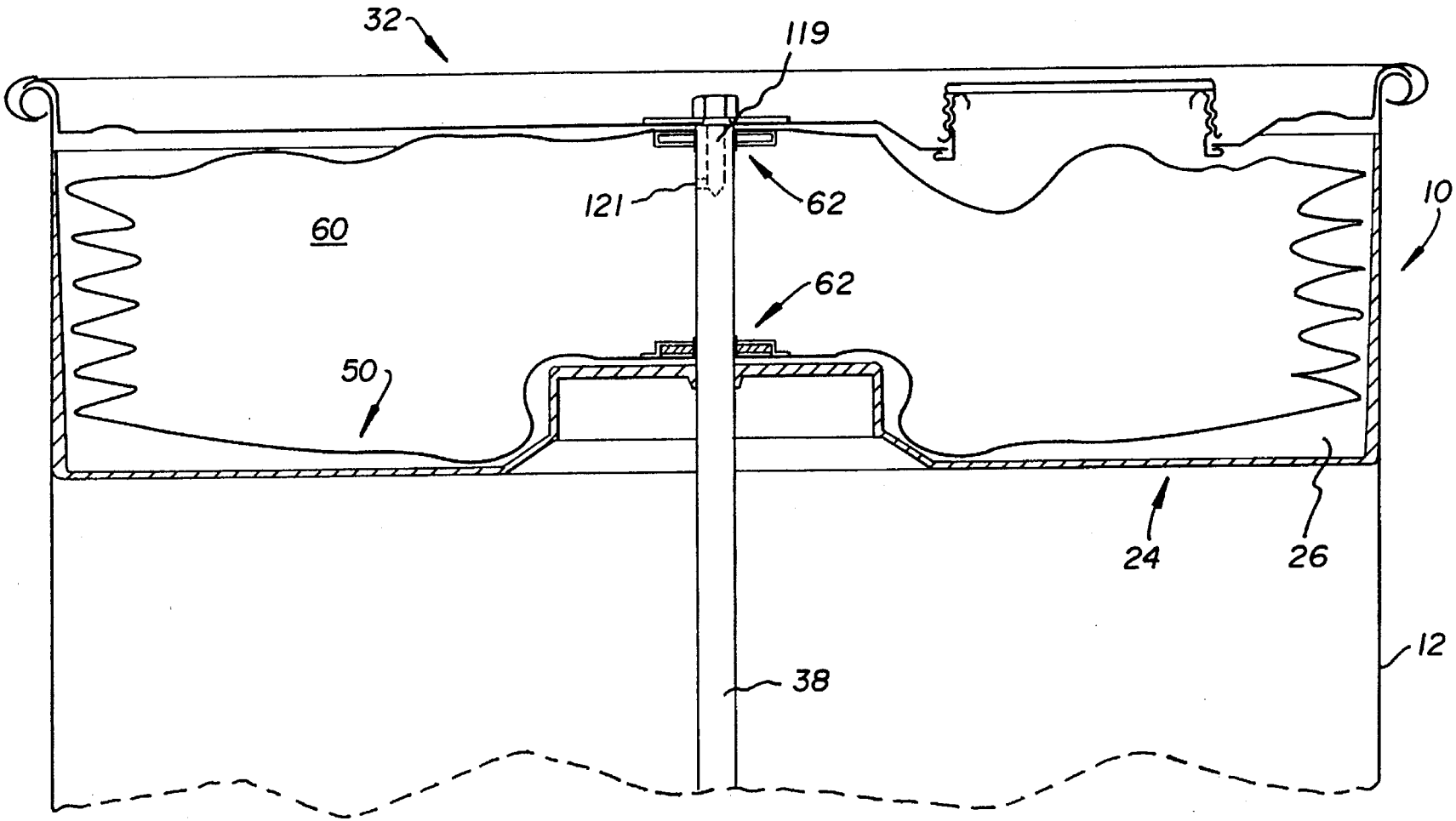
FIG. 11 is a detailed view of a sixth embodiment of the invention.

The embodiment of FIG. 11 shows yet a further example of the invention in which the piston 24 is arranged within the cylindrical wall 12 of the container 10 and the lid 32 is used to seal the container 10. A rod 38 is arranged within the container as in the previous embodiments and a complete bag is arranged within the space 26 above the piston 24. The rod 38 passes through the bag 50 and a pair of sealing members 62 identical to those previously described are provided for sealing the top and bottom of the bag where the rod 38 passes through it. The lower sealing member 62 is intended to move longitudinally along the rod as the bag 50 is inflated and the upper sealing member 62 will be forced against the lid 32 and will generally be retained in the place shown in FIG. 11. The rod 38 is provided with a longitudinal bore 119 and a transverse bore 121 which communicates the outside of the container 10 with the internal space 60 within the bag 50. Compressed air is allowed to enter the bag 60 through the bores 120 and 121 to inflate the bag 50 to thereby force the piston 24 downwardly to dispense material from the dispenser.

Figure 12:
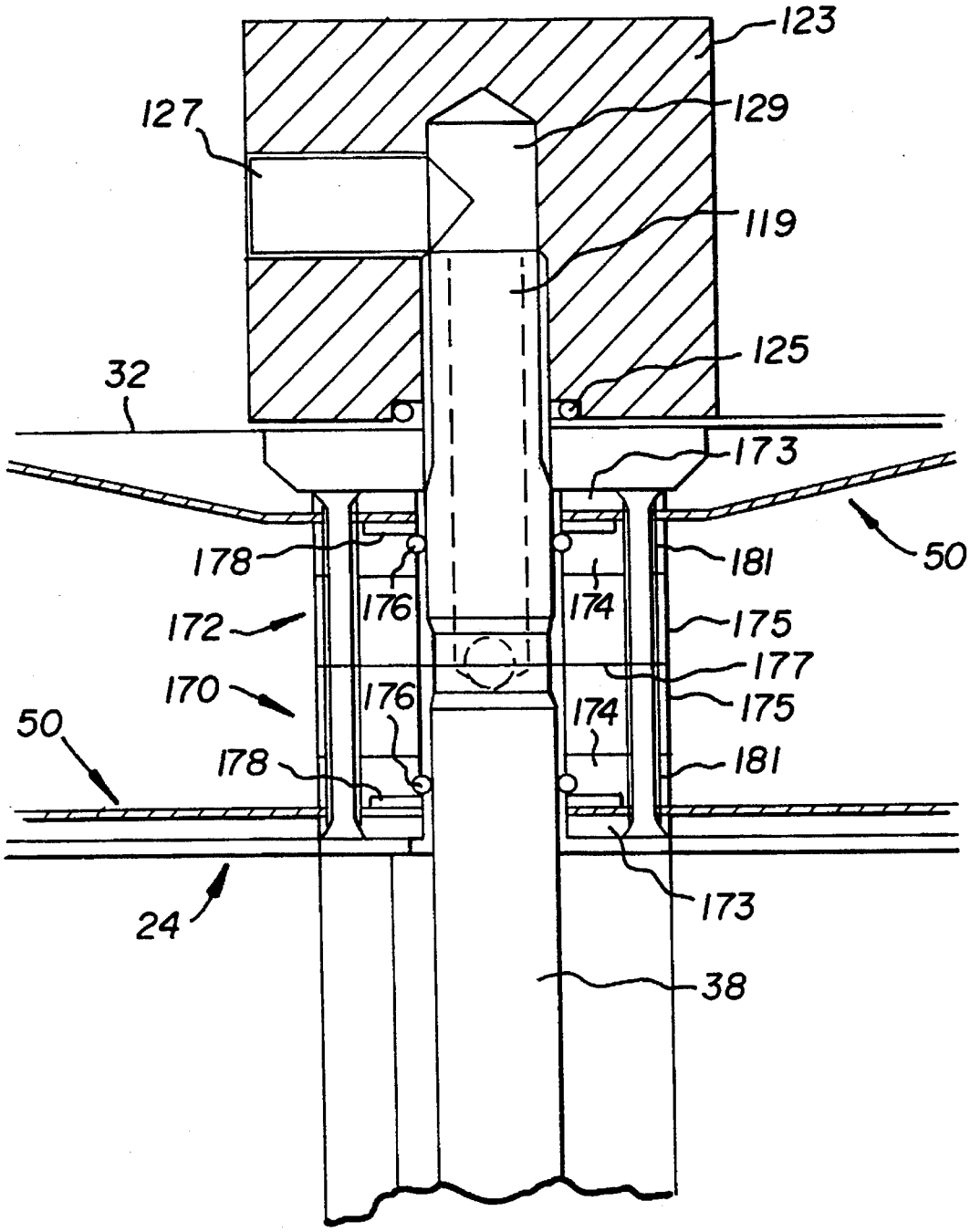
FIG. 12 is a view of a seventh embodiment of the invention.

With reference to FIG. 12 which shows a further embodiment of the invention for allowing air to enter the bag 50. In this embodiment the rod 38 passes through the bag 50 as in the embodiment of FIG. 12. The bag 50 includes a pair of seals 170 and 172 which are generally identical and mirror images of one another. The seals 170 and 172 comprise a first clamp portion 173 and the second clamp portion 174. Cylindrical sleeves 175 surround the clamp portions 173 and 174. The clamp portions 174 support O-rings 176 which seal against rod 38. Each of the clamp portions 174 supports a washer 178 and the bag 50 is arranged between the washer 178 and clamp portions 173 with the rod 38 passing through holes in the bag 50.

The clamp portions 173 and 174 have screw threaded holes 181 for receiving bolts (not shown) so the bolts can be screwed into the holes 181 to cause the clamp portions 173 and 174 to be drawn together and tightly clamp the respective parts of the bag 50 between the respective washers 178 and clamp portions 173.

The rod 38 is provided with a bore 120 which extends longitudinally down the rod 38 from the top of the rod. A bore 121 extends transverse to the bore 120 and communicates with the interior of bag 50.

A nut 123 is screw threaded on rod 38 and the nut 123 supports an O-ring 125 which seals the nut against lid 32. The nut 123 is provided with a transverse bore 127 and a longitudinal bore 129 which communicates with the bore 120. The bore 127 can receive a screw threaded fitting for attachment of an air hose so that compressed air can pass through the bore 127, bore 129, bore 120 and bore 121 into the bag 50 to inflate the bag.

In the arrangement shown in FIG. 12, the two cylindrical sleeves 175 of the respective seals 170 and 172 are shown touching one another at their ends identified by line 177. Normally in manufacture and after filling of the container with the component there will be a slight space between the cylindrical sleeves 175 which will easily allow the air exiting bore 121 to pass into bag 50. However, even if the cylindrical sleeves 175 do touch one another they will not form a seal in view of irregularities at the ends 177 and air will easily be able to pass between the cylindrical sleeves 175 and fill the bag 50.

As the piston 24 begins to move down when the bag 50 inflates, the sealing member 170 together with its associated cylindrical sleeve 175 moves downwardly relative to the rod 38 whilst maintaining the seal on the rod 38. The upper seal 172 is fixed to lid 32 by screws or the like (not shown) so that the seal 172 remains in a position shown in FIG. 12.

In alternative embodiments not shown the diaphragm 50 could be adhered directly to the wall 12 of the container rather than being clamped or sandwiched as in the earlier embodiments. Instead of employing a piston 24 which is separate to the diaphragm 50 or bag 50, the piston could be embodied in a diaphragm or bag by making the base of the diaphragm or bag out of relatively stiff material or by stiffening the bottom so that it effectively forms a piston which is part of the bag or diaphragm.

Since modifications within the spirit and scope of the invention may readily be effected by persons skilled within the art, it is to be understood that this invention is not limited to the particular embodiment described by way of example hereinabove.

We claim:

1. A dispenser for dispensing a component comprising:

a container, including a container wall, for containing the component to be dispensed;

a space in the container;

a piston arranged between the component and the space, said piston having a base portion and an upstanding wall portion, the piston being movable from an initial position to an end position to dispense substantially all of the component from the dispenser;

an expandable fluid chamber arranged within the space, the fluid chamber having a side wall;

a means for enabling supply of fluid to the fluid chamber to expand the fluid chamber to occupy substantially the entire space in the container to allow the piston to move from the initial position to the end position, the side wall having a folded portion which, when the piston is in the initial position, is folded in a concertina fashion within the upstanding wall portion with sections of the folded portion arranged transverse to the direction of movement of the piston and which, when the chamber is expanded, is of sufficient length to cause the piston to move to the end position, the portion being within the confines of the piston defined by the base and upstanding wall when the piston is in the initial position; and wherein when the expandable fluid chamber is progressively filled with the fluid, the piston is progressively forced toward the end position and the sections of the folded portion of the side wall are progressively unfolded, drawn out of the confines of the piston as the piston moves, and forced flat against the container wall, and before being drawn out the sections are prevented from contacting the container wall by the upstanding wall portions of the piston.

2. The dispenser of claim 1, wherein the expandable fluid chamber comprises a diaphragm which has an upper portion fixed to the container.

3. The dispenser of claim 1, further including an air vent passage which communicates the space in the container with the exterior of the container so that when the expandable fluid chamber is expanded, air in the space outside the chamber is expelled out of the space through the vent passage as the chamber expands to substantially occupy the space.

4. A dispenser for dispensing a component, comprising:

a container for containing the component to be dispensed and a space in the container;

a rim on the container having a fold for forming an external wall portion on the container and an internal wall portion on the container, the wall portions forming therebetween a first annular channel formed in the container and opening inwardly of the container;

a lid for closing the container;

a diaphragm arranged in said container;

a securing member located in said first channel to secure said diaphragm to the container, the securing member being secured in the first channel of the container; and wherein the diaphragm is arranged in folded or collapsed fashion in the space in the container and wherein compressed fluid is supplied to the diaphragm to cause the diaphragm to extend or expand to thereby dispense the component from the dispenser.

5. The dispenser of claim 4, wherein a piston is disposed between the diaphragm and the component in the container.

6. The dispenser of claim 4, wherein the securing member is a ring separate from the diaphragm, the ring being received in the channel for sandwiching the diaphragm between a wall of the channel and the ring.

7. The dispenser of claim 4, wherein the container has a second annular channel opening outwardly of the container for receiving a rim of the lid to secure the lid to the container.

8. The dispenser of claim 4, wherein the container includes a reinforcing rod which extends between an upper portion of the container and a lower portion of the container, said diaphragm including an opening for receiving said rod and a seal member for sealing the diaphragm to the rod.

9. The dispenser of claim 8, wherein the seal member is movable longitudinally along the rod as the diaphragm moves to dispense material from the container.

10. The dispenser of claim 8, wherein the seal member comprises a strengthening ring having a hole, which surrounds the opening in the diaphragm through which the rod passes, the diaphragm having a peripheral portion surrounding the opening and the peripheral portion extending into the hole of the strengthening ring between the strengthening ring and the rod, and said strengthening ring being coupled to said diaphragm.

11. The dispenser of claim 10, wherein the strengthening ring is coupled to the diaphragm by a patch which has an opening for accommodating the rod, the patch overlapping the strengthening ring so that the strengthening ring is sandwiched between the diaphragm and the patch, and the patch and diaphragm being adhered together to secure the strengthening ring to the diaphragm.

12. The dispenser of claim 8, wherein the dispenser includes an air vent passage which communicates the space in the container with the exterior of the container, so that when the diaphragm is expanded, air in the space outside the diaphragm is expelled out of the space through the vent passage as the diaphragm expands to substantially fully occupy the space.

13. The dispenser of claim 12, wherein the vent passage comprises a bore through the rod, the bore having one end communicating with the exterior of the container and another end communicating with the space.

14. The dispenser of claim 4, wherein the dispenser is a dual dispenser for dispensing two components and includes a first container portion and a second container portion, the second container portion being arranged within the first container portion, and the diaphragm having an outer wall and an inner wall, the inner wall defining a cavity for accommodating the second container portion.

15. The dispenser of claim 14, wherein both the outer wall and inner wall of the diaphragm are folded in concertina fashion and when compressed air fills the diaphragm to expand the diaphragm the inner wall expands over the second container portion.

16. The dispenser of claim 4, wherein the diaphragm is folded in concertina fashion in the space prior to expansion.

17. A dispenser comprising:

a container for containing a substance to be dispensed from the dispenser;

a diaphragm for forcing the substance out of the container;

an internal element in the container which passes through an opening in the diaphragm by which the diaphragm moves relative to the internal element;

a seal member on the diaphragm for sealing the diaphragm to the internal element, the seal member comprising:

a strengthening ring having a hole, which surrounds from a distance the opening in the diaphragm through which the internal element passes, the diaphragm having a flexible peripheral portion extending into the hole of the strengthening ring between the strengthening ring and the internal element which forms the seal to the internal element, and said strengthening ring being coupled to said diaphragm to prevent the flexible peripheral portion of the diaphragm from pulling away from the internal element and breaking the seal between the flexible peripheral portion and the internal element.

18. The dispenser of claim 17, wherein the strengthening ring is coupled to the diaphragm by a patch which has an opening for accommodating the internal element, the patch overlapping the strengthening ring so that the strengthening ring is sandwiched between the diaphragm and the patch, and the patch and diaphragm being adhered together to secure the strengthening ring to the diaphragm.

19. The dispenser of claim 17 wherein the internal element comprises a reinforcing rod.

20. The dispenser of claim 17 wherein the internal element comprises a second container for containing a second component to be dispensed from the dispenser.

21. The dispenser of claim 17 wherein the diaphragm is folded in concertina fashion prior to expansion of the diaphragm.

22. A dispenser for dispensing at least one component comprising:

a container having an outer wall for containing the at least one component;

an internal element within the container;

a diaphragm in the container for receiving fluid on one side thereof to expand the diaphragm and move a base section of the diaphragm relative to the outer wall to force the at least one component disposed on the other side of the diaphragm out of the container, the diaphragm comprising:

(a) an outer wall joining the base section at an outer periphery thereof and arranged adjacent to the outer wall of the container; and (b) an inner wall joining the base section near an inner periphery thereof and arranged adjacent to the internal element and defining, with a top portion which extends over the internal element, a cavity for accommodating the internal element during movement of the base section of the diaphragm.

23. The dispenser of claim 22 wherein the inner and outer walls of the diaphragm are folded in concertina fashion prior to expansion of the diaphragm.

24. The dispenser of claim 22 wherein the internal element comprises a reinforcing rod.

25. The dispenser of claim 22 wherein the internal element comprises a second container for containing a second component to be dispensed from the dispenser.

26. A dispenser for dispensing a component comprising:

a container for containing the component;

a space in the container;

an expandable fluid chamber arranged within the space for receiving compressed fluid for expanding the chamber to thereby dispense material from the container;

a rod extending between an upper portion of the container and a lower portion of the container;

an air vent passage communicating the space with the exterior of the container, so that upon expansion of the fluid chamber air in the space is forced out of the space by expansion of the fluid chamber; and wherein the air vent passage comprises a bore extending through the rod and having one end communicating with the exterior of the container and another end communicating with the space in the container.

27. The dispenser of claim 26, wherein the fluid chamber includes a diaphragm arranged in the space and which together with a lid of the container defines an enclosed volume for receipt of pressurised air to enable the diaphragm to expand.

28. A dispenser for dispensing a component comprising:

a container for containing the component;

a space in the container;

an expandable fluid chamber arranged within the space for receiving compressed fluid for expanding the chamber to thereby dispense material from the container;

an air vent passage communicating the space with the exterior of the container, so that upon expansion of the fluid chamber air in the space is forced out of the space by expansion of the fluid chamber; and wherein the air vent passage comprises a hose which is arranged within the fluid chamber and which has one end in communication with the space exterior of the fluid chamber and another end communicating with the exterior of the container.

29. The dispenser of claim 28, wherein the container includes a rod which extends from an upper portion of the container to the bottom of the container.

30. A dispenser for dispensing a component comprising:

a container for containing the component to be dispensed, the container having a wall and a lid and a base, the lid and base being fixed to the container wall;

a space in the container;

an expandable fluid chamber arranged within the space for receiving compressed air;

a reinforcing rod extending through the container and into the expandable fluid chamber, the rod having a passage therethrough which communicates with the expandable air chamber to enable compressed fluid to enter the expandable fluid chamber to expand the expandable fluid chamber, the rod extending from a top portion of the container to a bottom portion of the container and the passage in the rod extends from an upper portion of the rod, through the rod and communicates with the interior of the expandable air chamber; and a coupling means for respectively coupling the rod to the lid and to the base for preventing the lid and the base from bowing during movement of the piston.

31. An expansion member for a dispenser, which is expanded to force the contents of the dispenser out of the dispenser, said member including:

at least one hole for allowing an element to pass through the hole; and a seal on the member for sealing the member to the element, the seal comprising:

a strengthening ring having an opening, which surrounds the hole in the member through which the element passes, the member having a peripheral portion for extending into the opening of the strengthening ring between the strengthening ring and the element, and said strengthening ring being coupled to said member by a patch which has an opening for accommodating the element, the patch overlapping the strengthening ring so that the strengthening ring is sandwiched between the member and the patch and the patch and member being adhered together to secure the strengthening ring to the member.

* * * * *